US005931568A

United States Patent [19]

Chuang

[11] Patent Number: 5,931,568

[45] Date of Patent: Aug. 3, 1999

[54] CHRISTMAS LAMP STRUCTURE

[76] Inventor: Wen-Pin Chuang, No. 24, Lane 47, Dining Meei St, Hsing Chu, Taiwan

[21] Appl. No.: 08/926,744

[22] Filed: Sep. 10, 1997

[51] Int. Cl.[6] ..... F21V 3/00

[52] U.S. Cl. ..... 362/311; 362/122; 362/353; 362/363

[58] Field of Search ..... 362/122, 363, 362/806, 249, 351, 353, 311

[56] References Cited

U.S. PATENT DOCUMENTS 5,361,192 11/1994 Lai ..... 362/806
5,414,605 5/1995 Lin ..... 362/806
5,499,174 3/1996 Lin ..... 362/363
5,513,086 4/1996 Ho ..... 362/363
5,517,394 5/1996 Lin ..... 362/353
5,800,047 9/1998 Yang ..... 362/806

*Primary Examiner*—Stephen Husar
*Attorney, Agent, or Firm*—Pro-Techtor International Services

[57] ABSTRACT

A Christmas lamp structure that includes a decorative casing that allows light from a bulb to pass through. The casing will typically be shaped to resemble some type of fruit. A base of the bulb includes an annular stop to secure an engaging annulus of the casing in the base so that the casing does not fall out of the base.

4 Claims, 3 Drawing Sheets

CHRISTMAS LAMP STRUCTURE

BACKGROUND OF THE INVENTION

1. Field of the Invention

The present invention is related to an improved Christmas lamp structure, and especially to a structure which is provided thereon with a fruit shaped casing with suitable color and transparency, so that a bunch of Christmas lamps are rich in visual aspects, such innovative aspects can increase fun during Christmas festivals.

2. Description of the Prior Art

Conventional Christmas lamps mostly are in the shapes of cylinders or balls, and only have some variation in colors, they never have significant breakthrough in modeling, the atmosphere of Christmas festivals may fade gradually from year to year.

SUMMARY OF THE INVENTION

In view of this, the inventor provides the present invention based on his knowledge of such kind of products and quite a lot of experience on scores of patents of his own, in order to get rid of boring resided in the conventional Christmas lamps with variety, and this may increase competition of the Christmas lamps produced.

An object of the present invention is to provide a fruit shaped casing with suitable color and transparency on a Christmas lamp bulb, so that the Christmas lamp can be rich in visual aspect, this can increase fun during Christmas festivals.

Another object of the present invention is to provide a structure which can allow fittingly engagement of the casing with a base for the lamp bulb, and meantime can further clamp tight the casing to prevent the latter from dropping.

The present invention will be apparent in its practical structure and functions after reading the detailed description of the preferred embodiment thereof in reference to the accompanying drawings.

DETAILED DESCRIPTION OF THE PREFERRED EMBODIMENT

Figure 1:
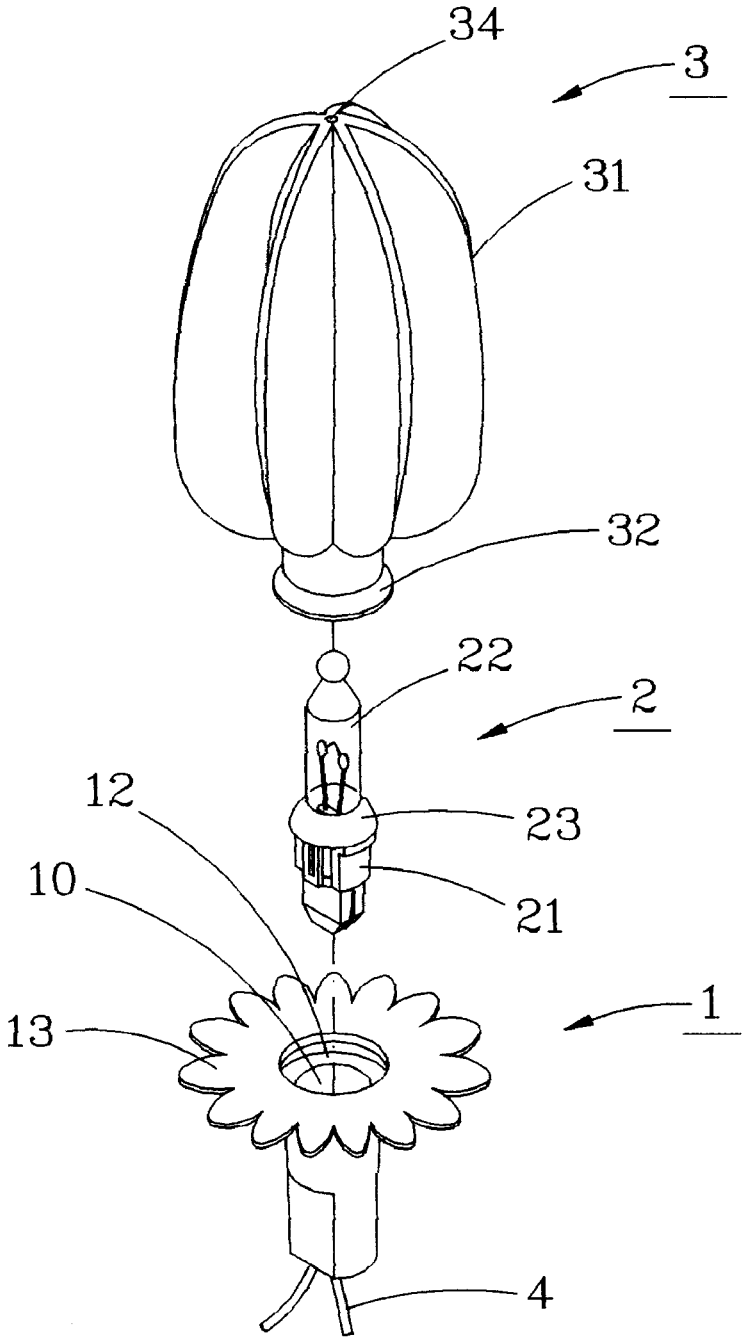
FIG. 1 is an analytic perspective view of the present invention.
Figure 2:
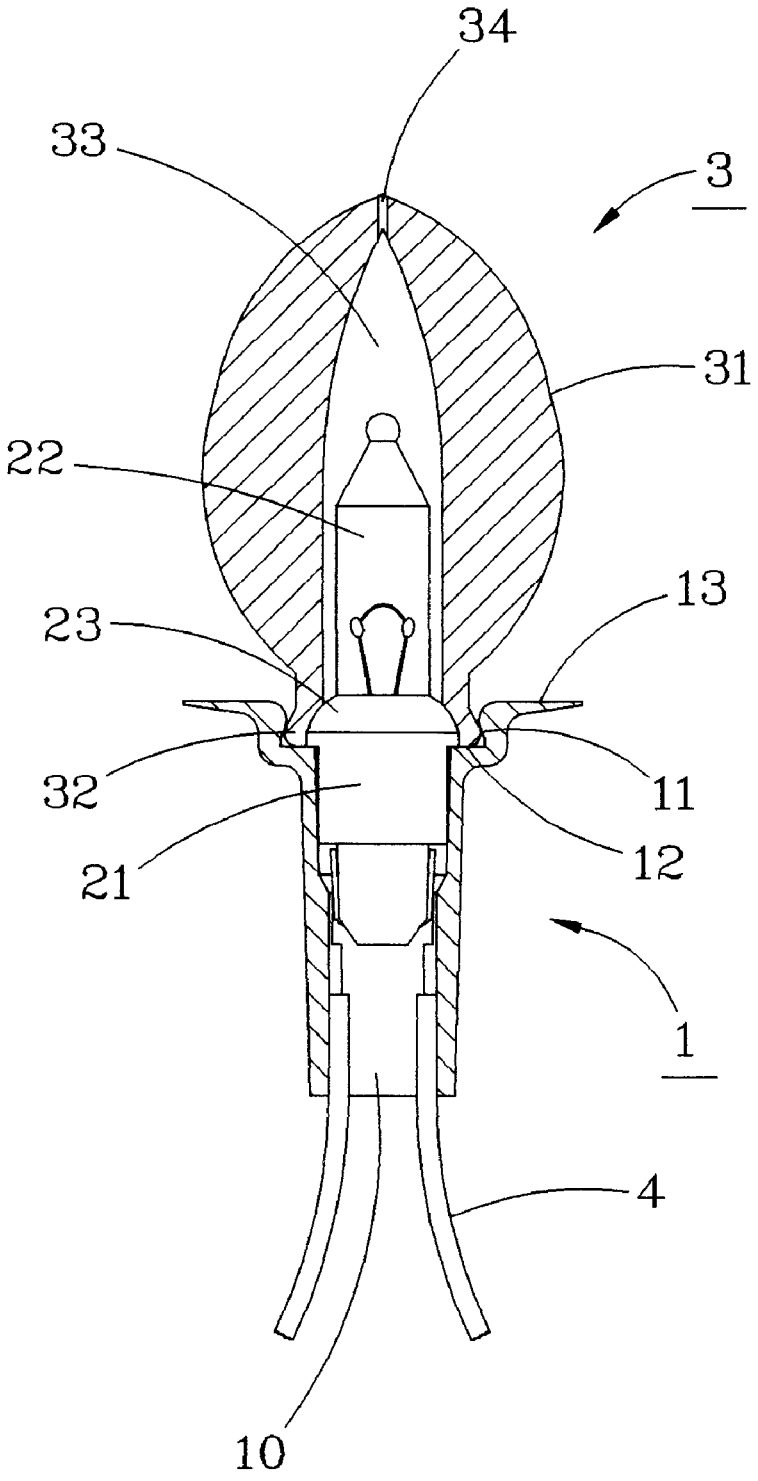
FIG. 2 is a sectional view of the structure of the present invention.

Referring to FIG. 1 and 2, the present invention is comprised of the main members of a base 1, a lamp bulb 2 and a casing 3, wherein:

The base 1 is provided at the center thereof with a receiving space 10 for insertion of the lamp bulb 2, the base 1 is provided on the top thereof with a horizontally extending base annulus 12 and an upright but slightly bevelled stop annulus 11 which is further provided peripherally with a leaf 13 extending outwards, the leaf 13 is made of PVC in this embodiment.

The lamp bulb 2 is comprised of a seat 21 for the lamp bulb 2, a bulb body holder 23 and a bulb body 22, it can light as is the function and characteristic of a conventional lamp bulb, and is simply inserted in the bulb body holder 23.

The casing 3 is made of material such as PS being suitably dyed but still being transparent, the upper portion thereof is a housing 31 in the shape of a fruit, the bottom thereof is provided with an engaging annulus 32, and it is provided internally with a hollow space 33 for fitting over the bulb body 22, and an air hole 34 is provided on the top thereof.

When the above mentioned members are assembled, such as is shown in FIG. 2, the seat 21 is received and positioned in the receiving space 10 of the base 1, then the engaging annulus 32 of the casing 3 is inserted into the gap between the base annulus 12, the stop annulus 11 and the bulb body holder 23, the slightly bevelled stop annulus 11 renders the casing 3 to be closely engaged with the base 1, now we can see another advantage of the present invention: the engaging annulus 32 can clamp the bulb body holder 23 tightly onto the bulb body 22, so that no dropping of the lamp bulb 2 will occur such as is the case on a conventional Christmas lamp, even if the bulb body 22 is shaked or moved.

Figure 3:
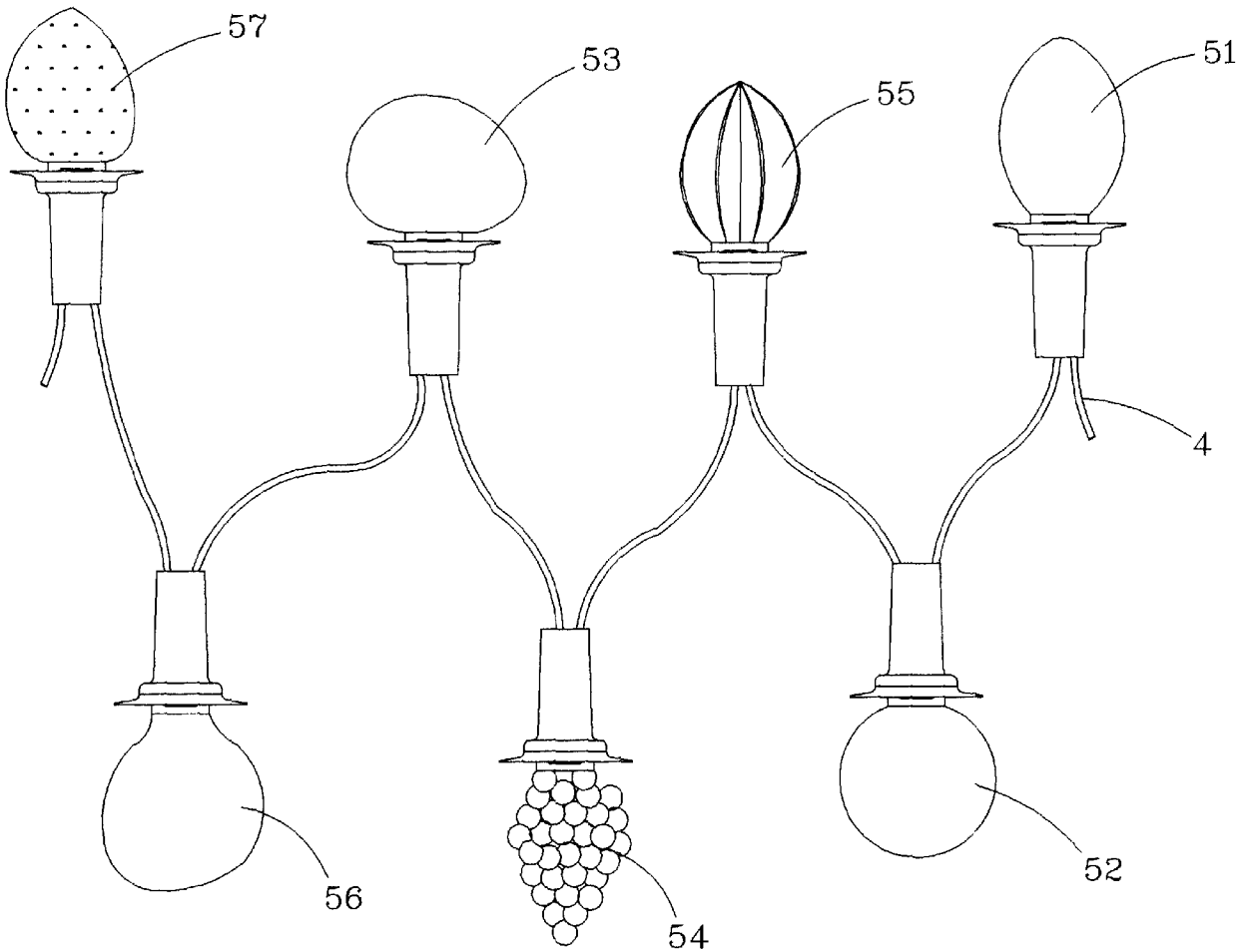
FIG. 3 is perspective view showing an embodiment of the present invention.

The fruit shaped housing 31 of the present invention can be endued with suitable color to obtain the best visual effect. Referring to FIG. 3, for example, a lot of casings 3 are in various shapes, the one in the shape of a lemon 51 is made dark green, an orange 52 is made in the orange color, a cherry 53 is made reddish black, a bunch of grapes 54 are made purple, a star fruit 55 is made yellow, a guava 56 is made jade green, a strawberry 57 is made red etc., when the Christmas lamps with fruit shaped casings are hung on a Christmas tree, we can imagine what a beautiful scene it will be! The brand new effect can be easily appreciated.

The above stated structure is only for illustrating a preferred embodiment of the present invention. It will be apparent to those skilled in this art that various modifications or changes can be made to the elements of the present invention without departing from the spirit, scope, function and object of this invention. Accordingly, all such modifications and changes also fall within the scope of the appended claims and are intended to form part of this invention.

In conclusion, the improved christmas lamp structure of the present invention endues the conventional Christmas lamps with brandnew life, it not only is innovative in the assembling structure thereof, but also is a significant breakthrough and revolution in visual aspect, therefore, having thus described the technical structure of my invention with practicability and improveness, the structure has never existed in the markets or disclosed in a publication.

What I claim as new and desire to be secured by Letters Patent of the United States are:

1. A Christmas lamp structure comprising:

a base, a lamp bulb, and a hollow casing: wherein said lamp bulb is received in said base, said base includes in an upper end thereof a receiving space, a bottom of said receiving space includes a base annulus, an inner wall of said receiving space is angled inward with a protrusion at a top end thereof so as to form a stop annulus, said inner wall is slightly flexible, and said casing is formed from a light transmitting, colored material, said casing is also formed with a decorative shape so that said lamp structure may resemble a decorative object, a bottom end of said casing includes an engaging annulus, said engaging annulus abuts said base annulus when said casing is inserted therein, sufficient force being applied to said casing to spread said stop annulus to allow said casing to be inserted, said stop annulus thereafter securing said engaging annulus of said casing in position so that said casing cannot fall from said base.

2. The Christmas lamp structure defined in claim 1 wherein:

said receiving space includes on an outer wall thereof an outward extending element formed to resemble a leaf.

3. The Christmas lamp structure defined in claim 1 wherein:

said base is formed from PVC.

4. The Christmas lamp structure defined in claim 1 wherein:

said casing is formed from PS.

* * * * *